United States Patent [19]

Viramontes

[11] Patent Number: 4,575,887

[45] Date of Patent: Mar. 18, 1986

[54] METHOD FOR ABRADING FABRIC GARMENTS

[76] Inventor: Julio C. Viramontes, 1057 Eastside Rd., El Paso, Tex. 79915

[21] Appl. No.: 645,909

[22] Filed: Aug. 29, 1984

[51] Int. Cl.[4] ..... D06F 21/04

[52] U.S. Cl. ..... 8/158; 8/159; 51/313; 68/18 F; 68/29; 210/767; 428/91

[58] Field of Search ..... 8/147, 150, 158, 159, 8/102, 137; 68/18 F, 29, 30, 142; 69/23, 28, 30; 26/19, 28; 51/313, 316; 428/91; 210/167, 767

[56] References Cited

U.S. PATENT DOCUMENTS 2,351,198 6/1944 Friedman ..... 69/23
2,433,620 12/1947 Monsaert, Sr. ..... 8/159 X
4,218,220 8/1980 Kappler et al. ..... 8/102

FOREIGN PATENT DOCUMENTS 3126699 2/1982 Fed. Rep. of Germany ..... 68/13 R
799788 8/1958 United Kingdom ..... 8/159

*Primary Examiner*—Philip R. Coe
*Attorney, Agent, or Firm*—Gunn, Lee & Jackson

[57] ABSTRACT

A method of abrading fabric garments in a washing machine. The garments are placed in the washing compartment of a washing machine and the machine is filled with sufficient hot water to cover the garments. The garments are thoroughly soaked, and then the compartment is drained of sufficient water to enable the compartment to accept a predetermined amount of small sized abrasive particles to uniformly abrade the garments. The abrasive particles are added to the compartment and agitated until the garments are uniformly abraded. Next the compartment is drained of substantially all of the water and abrasive with the drainage fluid passing through a filter or trap capable of separating the abrasive from the water; rinsing and redraining are accomplished, and the sand removed from the filter for reuse in subsequent abrading operations.

9 Claims, No Drawings

METHOD FOR ABRADING FABRIC GARMENTS

BACKGROUND OF THE INVENTION

This invention relates to a method for abrading fabric garments in both commercial and household-type washing machines. More particularly the method of the invention relates to what is commonly known in the laundry industry as "stone washing."

Current methods of stone washing fall into two general categories. The first is a method which utilizes large pumice stones (2 inches to 4 inches in diameter and larger) in the washing process. In the pumice stone method, large pumice stones are placed within the washing cylinder of a washing machine along with the garments during the wash cycle. Numerous significant disadvantages exist with the pumice stone method. First the stones bang against the inside of the cylinder during the agitation step, causing damage to the inside of the cylinder, and resulting in breakage of the stones. When the stones strike the inside of the cylinder, garments are often pinched between the cylinder and the stone, producing holes and tears in the garments. When the stones break, sharp edges are formed on the stones and these contact the garment, also resulting in damage to the fabric. After each washing cycle, the stones must be laboriously removed from the cylinder as the garments are prepared for rinsing, removal and/or drying. Alternatively, the garments must be removed from the cylinder while leaving the stones in the cylinder. In either of the two aforementioned circumstances, laundry operators have to handle the sharp stones. The second existing method of stone washing garments utilizes a method whereby volcanic rock is used to actually abrade the cylinder in the washing machine. Garments are then put into the machine having this specially abraded cylinder, and the rough surface of the cylinder works on the garment, achieving the desired abrasion. The particular disadvantages with the abraded cylinder method relate to the need for repeated resurfacing of the cylinder after a number of washes. The abraded cylinder method also has a disadvantage in that it takes considerable time and energy to achieve adequate abrasion on the garment.

An existing problem with stone washing done with the current methods relates to "streaking" of the garments. In the normal circumstance, new fabric garments are received at the laundry after being folded and shipped by the manufacturer or customer. The weight of the garments lying one on top of the other causes the garments to have creases and folds prior to stone washing. When the garments are placed in the washing machines for the soaking cycle, the creased and folded garments rub against the inside of the cylinder wall, causing streaks where the creases or folds exist. Even though, in the pumice stone method, the stones may not be placed within the washing cylinder until after the soak cycle, laundries utilizing the pumice stone method have still experienced the streaking problem because of the abrasions on the inside of the cylinder as a result of the stones banging on the inner walls. With the abraded cylinder method, streaking can be eliminated by soaking the garments in non-abraded cylinders and then placing the soaked and softened garments into the specially abraded cylinders for the washing cycle. This additional step is labor and equipment cost intensive, and in practice is not done because of such factors.

Thus, obtaining uniform abrasion has not proved successful with existing methods. Because the garments must actually contact the cylinder walls in the abraded cylinder method, or contact the outer surface of the pumice stone in the pumice stone method, considerable time is required to achieve less than satisfactorily uniform abrasion.

SUMMARY OF THE INVENTION

The instant invention eliminates all of the aforementioned disadvantages of existing methods. In summary, after the fabric garments are placed in a receptacle capable of being agitated and are soaked in a liquid, a certain amount of liquid is drained from the receptacle, allowing for the addition of a predetermined amount of pumice sand or a small-sized particle abrasive and soap, if desired, to uniformly abrade and clean, if desired, the garments. After agitation, abrasion, and cleaning of the garments, the receptacle is drained with the drainage liquid passing through a filter member or sand trap capable of separating the sand or small-sized particle abrasions from the liquid and soap. Sand traps are conventionally known in the industry. The garments are then rinsed with rinse liquid which is subsequently drained from the cylinder of the receptacle and also passed through the filter means. The filtered abrasive particles are collected for reuse in subsequent abrading operations. In household operations, the abrasive particles may not be filtered out of the liquid, allowing them to pass to the common sewer.

Thus, the method of the invention exposes the fabric garments to the considerably greater surface area of the abrasive particle material, providing for more uniform and faster abrasion. Because the individual particles of abrasive are much lighter than the stones of the pumice stone method, garments are not pinched, ripped, or torn between the particles and the cylinder wall.

Further, while the particle abrasive does cause minor abrasion to the inside wall of the cylinder of the washing machine, the abrasive does not cause the damage associated with the pumice stone method. The small-sized particle abrasive actually polishes the inside wall of the cylinder. Abrading operations utilizing the method of the invention have experienced considerably less maintenance expenses associated with repairs to the cylinder walls and little or no damage to the fabrics.

BRIEF DESCRIPTION OF THE DRAWINGS

Drawings have not been submitted because they are not necessary to understand the invention.

DETAILED DESCRIPTION OF PREFERRED EMBODIMENT

In the preferred embodiment of the present invention, a model 42×84 American, two-compartment washing machine is utilized. However, conventional household washing machines may be employed. Any receptacle capable of retaining and agitating the garments should work. Preferably, the machine is run continuously at one speed for all steps of the method of the invention. While the method described herein is not limited to only 14 oz. denim jeans, 14 oz. denim jeans will be utilized as the example. Any fabric or material can be abraded and washed by using the following method by varying the quantities of the ingredients and the "run" time.

Initially thirty-five 14 oz. denim jeans are placed in each washing compartment or cylinder of the washing machine. The compartments are then filled with sufficient hot water to completely cover the garments. In dry cleaning operations other appropriate liquids or solvents should be utilized. In this example, 12 inches of water at 140° F. is used. The temperature range can be anywhere from approximately 130° to approximately 170° F. for optimum operation. The washing compartment is then turned on to agitate, and the garments are agitated through a five-minute soak cycle. During this soak period the stiffness of the denim is broken down so as to prepare the garments for the cleaning and abrading steps. The time for the aforementioned soaking cycle may be reduced or increased slightly depending upon the quantity and weight of material placed in each compartment. In situations where the garments are not significantly creased, or the garments are of lightweight fabric, soaking may be eliminated.

After the soaking cycle has been completed, water is drained from each compartment, in the preferred embodiment, to an optimum level of eight inches. Again, the actual amount to be drained depends upon the quantity and weight of garments being handled. Once the water level has been lowered, approximately ten gallons of pumice sand is put into each compartment. A sufficient amount of soap, the cleaning medium, already known in the industry, is added to each compartment to achieve the cleaning of the garments. If no soap is needed, soap may be eliminated.

Continuing with the preferred example, the garments, water, sand, and soap are then agitated for approximately thirty minutes until uniform abrading and cleaning of the garments is achieved. Where fewer or lighter garments are placed in the compartments, less sand and agitation time is necessary. If heavier or a larger number of garments are in the compartments, more sand and agitation may be necessary.

As stated, in the preferred embodiment, pumice sand is utilized; however, naturally occurring or manufactured abrasive particles in the diameter range of 1/16 to 2 millimeters may be substituted and are within the scope of the invention.

To facilitate the addition of the abrasive particles to the compartment, particularly in household operations, the predetermined quantity of abrasive particles may be contained in small packages. The package wrapper may be of a soluble material which allows the particles to disperse in the liquid once the wrapper dissolves.

Once the garments are uniformly abraded and cleaned, the compartments are fully drained. The drainage fluid is passed through a filter means or sand trap which is capable of separating the pumice sand from the water and soap solution. The sand trap is capable of holding all of the sand which has been placed in the compartments, and does not allow the sand to enter the sewage system. The trap is conveniently located in the drainage flow from the discharge of the machine to the sewer so that the sand may be removed and the sand collected for reuse in subsequent washing operations. However, in normal operations, the sand trap is not cleaned until the entire cleaning, abrading, and rinsing steps have been completed and/or the traps are substantially filled. In household operations, it may be appropriate to allow the drainage to go directly to the sewer. Obviously, in such cases the abrasive particles are not recovered.

After the compartments have been drained, cold, clean rinse water sufficient to cover the garments is added to each compartment. In the example herein discussed, ten inches of cold rinse water is sufficient to cover the garments. Such water is water above the freezing point but below 100° F. In some circumstances, warm water may be used as is known in the laundry industry.

After the compartments are filled to the proper level with such rinse water, the contents of the cylinder are agitated for approximately five minutes to completely rinse the garments. The compartments are then drained with the drainage fluid passing through the filter means.

Depending upon the fabric type, weight of the garments, and the quantity of garments, the rinsing steps may need to be repeated until almost all of the sand and soap is removed from the garments.

Additional rinsing may then be accomplished by refilling the compartments to the proper level with additional clean, cold rinse water, agitating for additional five-minute periods, and again draining the compartments, with the drainage fluid again passing through the filter means.

During these subsequent rinses, a desired amount of fabric softener may also be added to the compartments. The amount of softener necessary is a function of the type of fabric, the quantity of garments, and the weight of the garments. The proper amount of softener to be utilized is known in the industry.

After the rinsing steps, or the fabric softening steps, if used, the garments are removed from the compartments and are then placed in an extractor in preparation for the drying process.

It is during the drainage after the abrading and rinsing cycles discussed above that the pumice said is flushed from the garments and the compartments. The pumice sand, having passed into the filter means, is ready for collection and subsequent reuse in further washing operations. In practice, small quantities of pumice sand do remain in the garments, but these fall from the garment during the extraction and/or drying steps. Both the extractors and the dryers contain filter means for collecting the sand which falls from the garments during these steps. The sand collected from the filters associated with the extractors and dryers is added to that recovered from the traps associated with the washers for a nearly complete recovery of the pumice sand utilized in this invention.

While the foregoing is illustrative of the preferred embodiments of the invention, it is clear that other modifications may be had within the scope of the invention.

I claim:

1. A method of abrading garments in a conventional household or commercial automatic washing machine which comprises the steps of:

a. placing said garments in a receptacle of said machine capable of agitation of said garments within said receptacle;

b. adding a predetermined amount of abrasive particles to said receptacle, said particles being less than 2 millimeters in diameter, said predetermined amount of particles sufficient to uniformly abrade said garments;

c. further adding to said receptacle a first liquid sufficient to circulate said abrasive particles within said receptacle;

d. agitating of said garments until said garments are uniformly abraded;

e. draining said receptacle through said machine's conventional drainage system of substantially all of said first liquid and said abrasive particles;

f. removing said uniformly abraded garments from said receptacle.

2. The method of claim 1 wherein said draining step is accomplished through a filter means capable of separating said first liquid from said particles.

3. The method of claim 2 further comprising the following steps prior to said removing step of at least a first filling said receptacle with a second liquid sufficient to cover said abraded garments;

at least a second agitating of said receptacle until said abraded garments are thoroughly rinsed with said second liquid;

at least a second draining of said receptacle of substantially all of said second liquid and substantially all of any residual amount of said particles; said second draining step to be accomplished through said filter means.

4. The method of claim 2 further comprising the steps of collecting said abrasive particles from said filter means for reuse in subsequent abrading operations.

5. The method of claim 1 wherein said first liquid contains a cleaning medium.

6. The method of claim 1 wherein said small sized abrasive particles are pumice sand particles.

7. The method of claim 1 wherein said predetermined amount of abrasive particles is packaged in a soluble membrane.

8. A method of abrading garments in a conventional household or commercial automatic washing machine which comprises the steps of:

a. placing said garments in a receptacle of said machine capable of agitation of said garments within said receptacle;

b. adding to said receptacle a sufficient amount of a first liquid to thoroughly soak said garments;

c. a first agitation of said garments within said receptacle;

d. further adding to said receptacle a predetermined amount of abrasive particles, said particles being less than 2 millimeters in diameter, said predetermined amount of particles sufficient to uniformly abrade said garments;

e. a second agitation of said garments until said garments are uniformly abraded;

f. draining said receptacle of substantially all of said first liquid and said abrasive particles; said draining step is accomplished through said machine's conventional drainage system and a filter means capable of separating said first liquid from said particles;

g. removing said uniformly abraded garments from said receptacle.

9. A method of abrading fabric garments in a washing machine which comprises the steps of a. placing said garments in an agitating compartment of said machine;

b. filling said compartment with sufficient hot water to cover said garments;

c. soaking and agitating said garments in said water in said compartment until said garments are thoroughly soaked;

d. draining sufficient water from said compartment to enable said compartment to accept a predetermined amount of pumice sand and soap to uniformly abrade and clean said garments, said sand having a particle size less than 2 millimeters in diameter;

e. adding said sand and said soap to said compartment;

f. agitating said garments, said water, said sand and said soap in said compartment until said garments are uniformly abraded and cleaned;

g. draining said compartment of substantially all of said water, said sand, and said soap; said draining step to be accomplished through said machine's conventional drainage system and a filter means capable of separating said sand from said water and said soap;

h. refilling said compartment with cold rinse water sufficient to cover said abraded and cleaned garments;

i. agitating said rinse water and said abraded and cleaned garments until garments have been throughly rinsed;

j. redraining said compartment of substantially all of said rinse water, said redraining step to be accomplished through said drainage system and said filter means;

k. removing of said abraded and cleaned garments from said compartment; and l. collecting said sand from said filter means for reuse in subsequent abrading operations.

* * * * *